United States Patent [19]

Salvan et al.

[11] Patent Number: 5,001,444

[45] Date of Patent: Mar. 19, 1991

[54] TWO-FREQUENCY RADIATING DEVICE

[75] Inventors: Michel Salvan, Pibrac; Didier René; Philippe Lepeltier, both of Toulouse; Thierry Dusseux, Tournefeuille, all of France

[73] Assignee: Alcatel Espace, Courbevoie, France

[21] Appl. No.: 454,825

[22] Filed: Dec. 22, 1989

[30] Foreign Application Priority Data

Dec. 26, 1988 [FR] France ..... 88 17184

[51] Int. Cl.[5] ..... H01P 5/12

[52] U.S. Cl. ..... 333/135; 333/21 A; 343/786

[58] Field of Search ..... 333/21 A, 126, 134, 333/135; 343/786

[56] References Cited

U.S. PATENT DOCUMENTS

| | | | |
|---|---|---|---|
| 3,731,235 | 5/1973 | Ditullio et al. | 333/135 |
| 3,864,687 | 2/1975 | Walters et al. | 343/778 |
| 4,434,425 | 2/1984 | Barbano | 343/797 |
| 4,758,806 | 7/1988 | Mohring et al. | 333/135 |
| 4,837,531 | 6/1989 | Gourlain et al. | 333/135 |

FOREIGN PATENT DOCUMENTS

| | | |
|---|---|---|
| 2118848 | 3/1974 | France . |
| 2429504 | 1/1980 | France . |

*Primary Examiner*—Paul Gensler

*Attorney, Agent, or Firm*—Sughrue, Mion, Zinn, Macpeak & Seas

[57] ABSTRACT

The present invention relates to a two-frequency radiating device comprising a waveguide radiating in a first frequency range opening out into a radiating element operating in a lower, second frequency range. The invention is particularly applicable to antennas.

9 Claims, 4 Drawing Sheets

TWO-FREQUENCY RADIATING DEVICE

Figure 1:
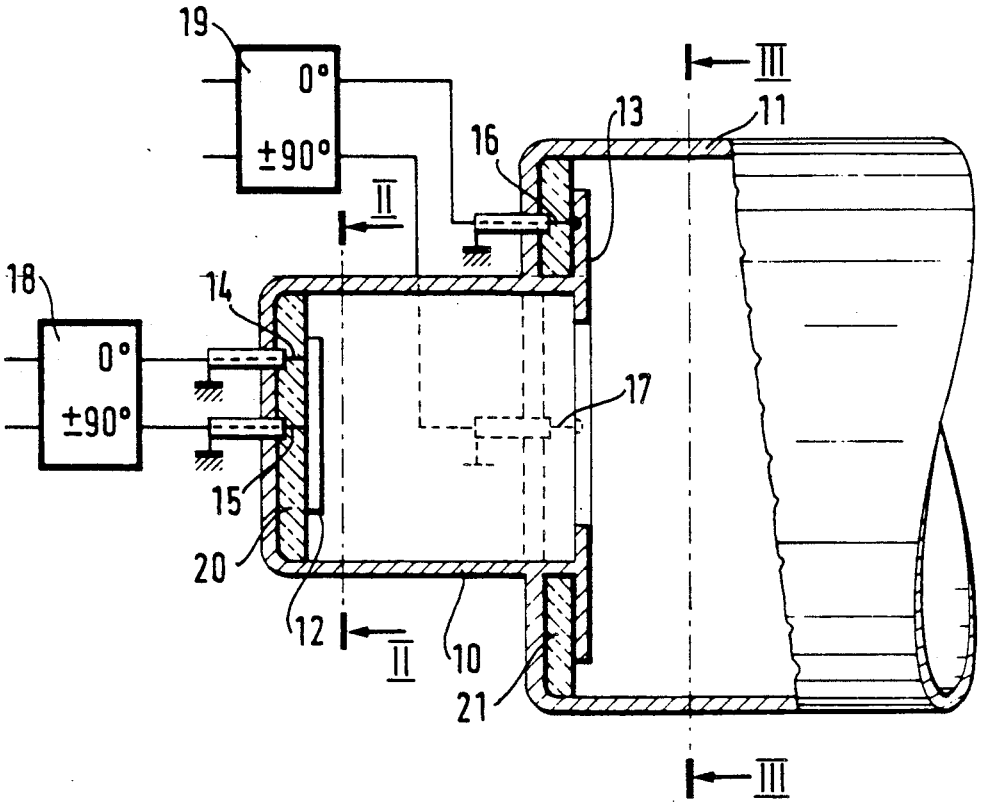

The invention relates to a radiating device capable of operating simultaneously in two different frequency bands. The device is capable of generating two orthogonal, linear or circular polarizations in each frequency band.

The advantage of the device is that it is very compact: in particular, it may be used in a two-band multisource antenna optionally operating with two different polarizations.

It may also be used in any waveguide radiating element requiring operation at two separate frequencies with compact excitation from an in-line TEM feed (e.g. a coaxial line, a three-strip plate, or a microstrip).

Known systems capable of operating at two frequencies generally require:

either filters to be used in order to ensure effective rejection of one frequency band relative to the other;

or else a combination of two types of radiating elements each operating in its own frequency band.

When two types of elements are used, it is difficult to achieve equal equivalent areas for both frequency bands and this is prejudicial to good multisource operation.

A prior art device described in French Pat. No. FR 2 598 034 (application Ser. No. 86 06 127, filed Apr. 28, 1986) relates to a microwave rotary joint device comprising a main circular waveguide constituted in two portions disposed in line with each other and moveable in rotation relative to each other about their axis of symmetry. For each of these two portions, there are two accesses which are orthogonal thereto and orthogonal to each other, which accesses are coupled to the outlets of a first hybrid coupler via two waveguides, and a cut-off guide having two accesses which are orthogonal thereto and orthogonal to each other. A hybrid coupler is connected to the inlets of these two guides.

However these various devices are bulky and not very compatible with multisource utilization.

The object of the device of the invention is to mitigate these drawbacks.

To this end, the present invention provides a two-frequency radiating device using two radiating elements and a discontinuity, the first radiating element being a waveguide which is excited in a first frequency range and which opens out into the second radiating element which is excited in a second frequency range, said two elements having a common axis of symmetry, the device being characterized in that the first frequency range is higher than the second frequency range, in that the first radiating element is beyond cut-off compared with the second frequency range in order to decouple the signals radiated by said two elements, and in that these two signals share the same radiating aperture.

Advantageously, such an element presents the following characteristics:

it is extremely compact; the circular polarization is directly generated in this case from a TEM line over a length which is shorter than one wavelength;

it is provided with longitudinal rear accesses, thereby making it possible to couple these accesses without additional coaxial cables to a TEM power transmission and/or reception manifold extending parallel to the waveguide section, at which location there may also be hybrid couplers for putting into quadrature;

it can be used with any circular polarization antenna in which there is a problem of compactness or bulk for the polarizing device; and the equivalent areas are identical in each frequency band since the waveguides in fed in fundamental mode.

Figure 2:
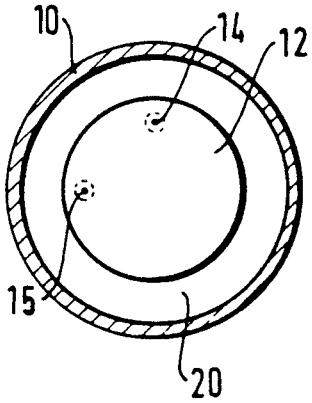
Figure 3:
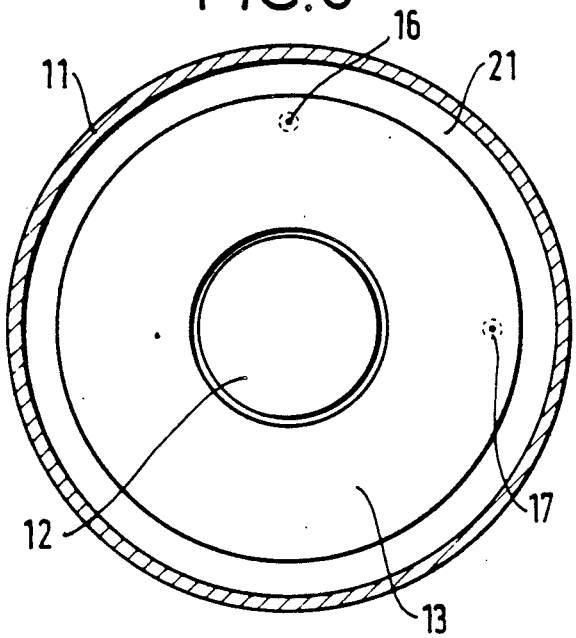
Figure 4:
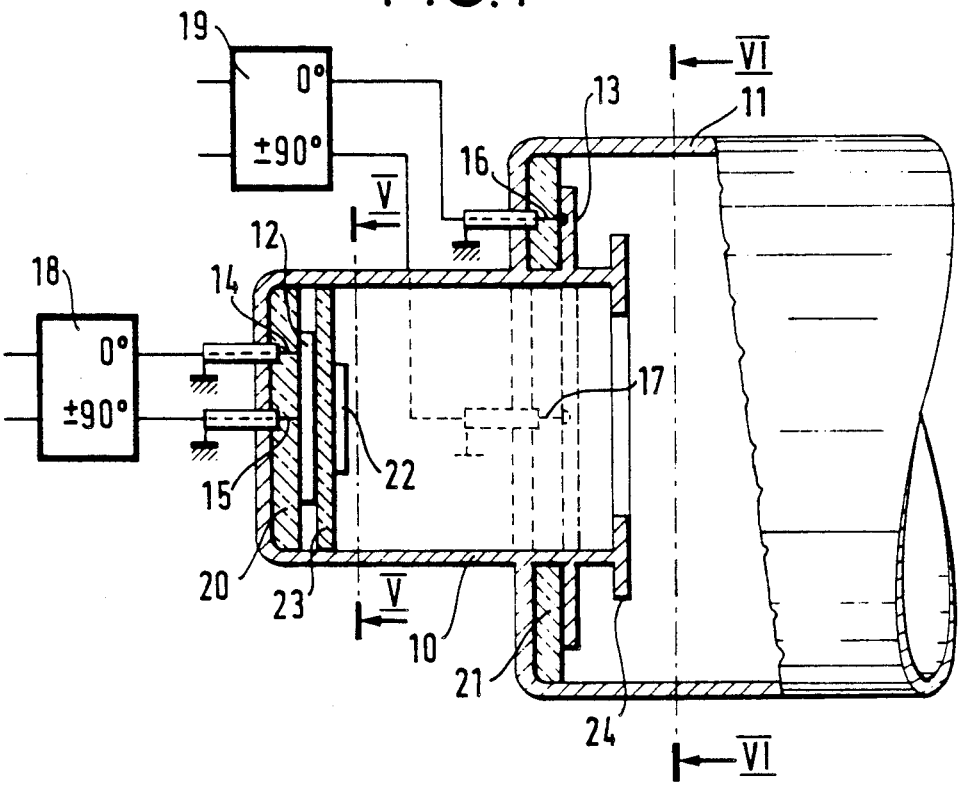
Figure 5:
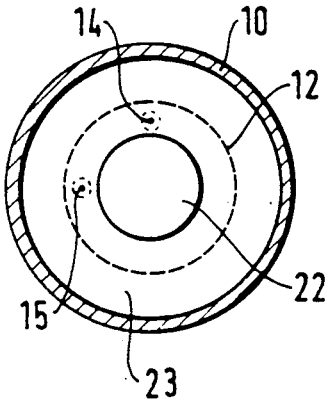
Figure 6:
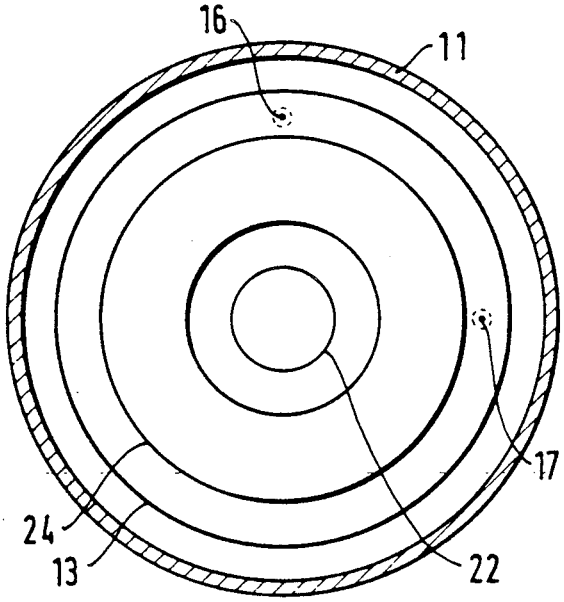
Figure 7:
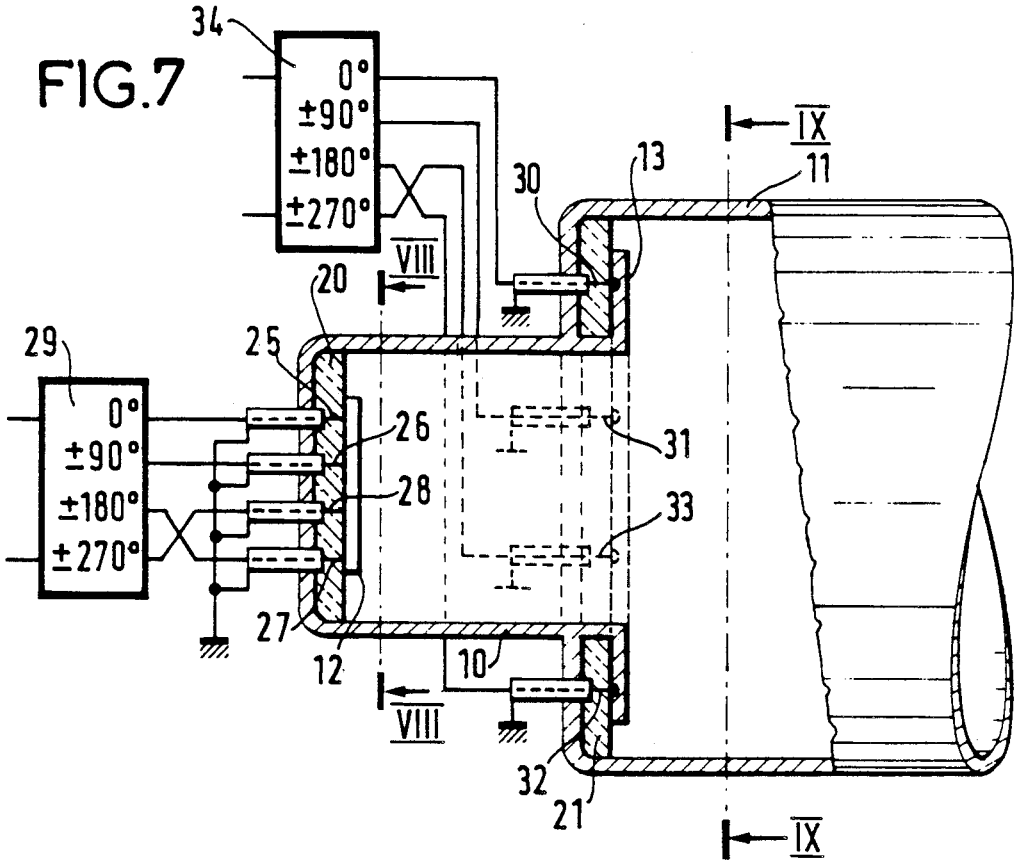
Figure 8:
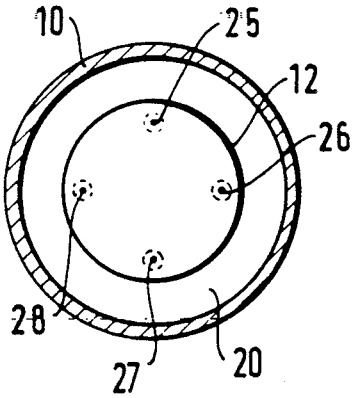
Figure 9:
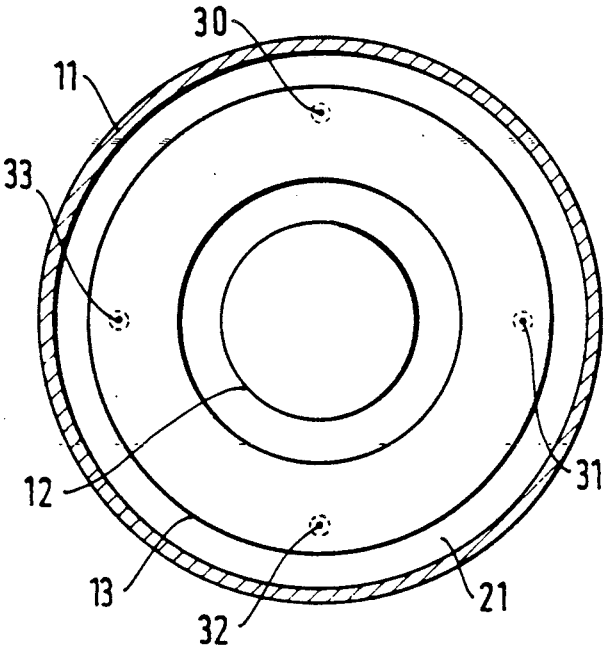
Figure 10:
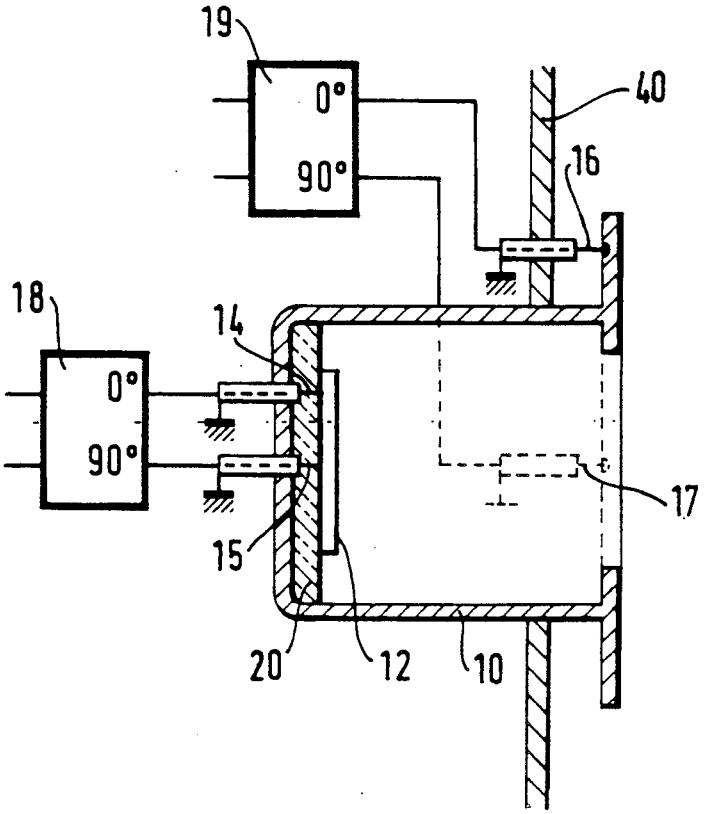

Further characteristics and advantages of the invention appear from the following description given by way of non-limiting example and with reference to the accompanying drawings, in which:

FIGS. 1, 2, and 3 are respectively a longitudinal section through a device of the invention and two cross-sections on planes II and III shown in FIG. 1;

FIGS. 4, 5, and 6 are respectively a longitudinal section through a first variant of the device of the invention, and two cross-sections on planes V—V and VI—VI shown in FIG. 4;

FIGS. 7, 8, and 9 are respectively a longitudinal section through a second variant of the device of the invention, and two cross-section views on planes VIII—VIII and IX—IX shown in FIG. 7; and FIG. 10 is a longitudinal section view through a third variant of the invention.

The device of the invention as shown in FIGS. 1, 2, and 3 comprises two radiating elements, e.g. two waveguides 10 and 11 having the same longitudinal axis. Each of the waveguides is excited by a linearly or circularly polarized printed antenna.

The first waveguide 10 is excited at the higher frequency and it is beyond the cut-off of the lower frequency which is directly generated in the second waveguide 11. In the first waveguide 10, the wave is excited by a printed or plate antenna 2, e.g. a resonant plate.

The second waveguide 11 is excited at the lower frequency by an annular flat antenna 13 having its central portion electrically connected (e.g. by welding) to the first waveguide 10. This annular flat antenna 13 or resonating ring thus constitutes a kind of annular flange on the first waveguide 10.

Each of the antennas 12 and 13 is fed by coaxial feeds 14, 15, 16, and 17. When circular polarization is generated in each of the two frequency-bands, each antenna is excited by two coaxial feeds 14 and 15 at the higher frequencies and by two coaxial feeds 16 and 17 at the lower frequencies. For each antenna, the matched coaxial feeds are situated at 90° from each other about the center of the waveguides. Each coaxial feed is fed in phase quadrature via a hybrid coupler (coupler 18 for the higher frequencies, coupler 19 for the lower frequencies). A branching hybrid coupler may be used, for example.

In order to improve wave ellipticity (with circular polarization), the hybrid couplers may be out of equilibrium in amplitude.

The hybrid couplers may alternatively be replaced by Ts, with one path of the T being elongated by an electrical length of 90°.

As shown in FIG. 3, the feeds 16 and 17 for the lower frequency second waveguide 11 are situated outside the perimeter of the first waveguide 10.

The higher frequency printed antenna 12 is separated from the end of the waveguide 10 associated therewith by a dielectric 20. The lower frequency antenna 13 is separated from the end of the associated waveguide 11 by a dielectric 21. The dimensions of the first waveguide 10 are calculated so that only the fundamental mode can exist at the higher frequency and so that the fundamental mode at the lower frequency cannot propagate. As a result isolation from the lower frequency band accesses is excellent.

The dimensions of the second waveguide 11 are calculated so that:

at the lower frequencies, only the fundamental mode can propagate; and at the higher frequencies, only non-excitable modes can propagate, thus, for example, when using a cylindrical waveguide, the TM 11 mode is beyond the cut-off at the higher frequency in the second waveguide 11 and therefore does not interfere with radiation from the opening of the waveguide. The TM 01 mode may propagate, but it is not excitable given the circular symmetry of the discontinuities.

Consequently, in each frequency band, only the fundamental modes participate in the radiation at the opening of the second waveguide 11.

The device of the invention, as shown in FIG. 1, may be used with the following dimensions:

for the higher frequency radiating element:

distance between each of the coaxial feeds 14 and 15 the center of the circular resonator 12: about 11.5 mm;

thickness of the dielectric 20: about 3 mm;

thickness of the resonator 12: about 0.5 mm;

diameter of the circular resonator 12: about 24 mm;

diameter of the cylindrical waveguide 10: about 35 mm; and distance between the ends of the guides: about 40 mm.

For the lower frequency radiating element:

distance between each of the coaxial feeds 16 and 17 and the center of the circular resonator 13: about 12 mm;

thickness of the dielectric 21: about 3.3 mm;

thickness of the resonator 13: about 0.6 mm;

diameter of the resonator 13 which is in the form of a circular ring: about 52 mm for its outside diameter and about 25 mm for its inside diameter; and diameter of the cylindrical waveguide: about 53.5 mm.

The following performance can then be obtained:

For the higher frequency radiating element:

frequency band width: 1.5% (e.g. 6400 MHz to 6500 MHz);

TOS matching in this band $<1.2$;

decoupling between coaxial feeds $<-20$ dB; and ellipticity with an appropriate hybrid coupler $<0.5$ dB.

For the lower frequency radiating element:

frequency band: 1.9% (e.g. 4160 MHz to 4240 MHz);

TOS matching in this band $<1.2$;

decoupling between the coaxial feeds $<-20$ dB; and ellipticity with an appropriate hybrid coupler $<0.5$ dB.

As shown in FIGS. 4, 5, and 6, one, or the other, or both of the two antennas may be constituted by a pair of resonators, thereby increasing the passband of the device.

The first waveguide 10 is excited at the higher frequencies by two concentric disks 12 and 22 spaced apart by a dielectric 23.

The second waveguide 11 is excited at the lower frequencies by two concentric rings 13 and 24. The two rings are integral with the waveguide and no dielectric is used for spacing them apart.

As shown in FIGS. 7, 8, and 9, one, the other, or both antennas may be constituted by a single resonator excited by four coaxial feeds fed in quadrature (0°, ±90°, ±180°, and 270°) by means of a device constituted by a hybrid coupler 34 and two rat races or hybrid rings, or from a hybrid coupler and two matched Ts. Each hybrid coupler, each rat race, or each T is balanced (3 dB coupler) and thus generates circular polarization in the waveguide. The hybrid coupler produces the phase quadrature required for circular polarization. The rat races or the Ts thus constitute devices providing symmetry, and may be replaced by other types of "balun" or balancing systems.

There are then four coaxial feeds 25, 26, 27, and 28 and a single excitation device 29 for the higher frequency antenna, and four coaxial feeds 30, 31, 32, and 33 and a single excitation device 34 for the lower frequency antenna.

As shown in FIG. 10, the second waveguide 11 may alternatively be constituted by a plane array 40.

Naturally the present invention has been described and shown merely by way of preferred example, and its component parts could be replaced by equivalent parts without thereby going beyond the scope of the invention.

The device of the invention may include one resonator for each band as shown in FIGS. 1, 2, and 3, two resonators for each band, as shown in FIGS. 4, 5, and 6 or one resonator with four coaxial feeds and appropriate excitation for each band as shown in FIGS. 7, 8, and 9, however it may alternatively include more than two resonators for each band: three, four, . . . .

These resonators are not necessarily circular in shape, they may be arbitrary in shape: circular, square, hexagonal, or they may have asymmetrical features or notches. They may also have gaps (non-metallized surfaces) of arbitrary shape within their outline.

Similarly, the dielectric layers 20, 21, and 23 supporting the resonators 12, 13, 22, and 24 may be replaced in part or completely by other types of support (spacers, small stand-off columns), and they may be made of any type of material (conducting or insulating) known to the person skilled in the art.

The resonators may be extended beyond their planes or within their planes by metal parts optionally making electrical contact with the wall of the waveguide. Thus, the shape of the waveguide used may not only be circular or square, but also hexagonal, polygonal, elliptical, or other. They may have features such as thickenings or grooves in the horizontal, oblique, or transverse directions or they may have local features such as pegs, irises, or slots. They may also be flared or tapering or both in succession, overall or locally, e.g. in accordance with a determined law.

Thus, the device of the invention may be fed by two, by four, or by a higher number of accesses, which may be connected to the first resonators 12 and 13, and also to other resonators 22, 24, . . . .

We claim:

1. A two-frequency radiating device using a first and second radiating element (10, 11) and a discontinuity, the first radiating element (10) being a first waveguide (10) which is excited in a first frequency range by a resonant plate (12) and which opens out into the second radiating element (11) which is a second waveguide frequency range by a resonant ring (13), said second radiating element including a flange having a central portion electrically connected to the first waveguide (10), said first and second elements (10 and 11) having a common axis of symmetry, the first frequency range being higher than the second frequency range; the first radiating element (10) being beyond cut-off compared with the second frequency range in order to decouple the signals radiated by said first and second elements (10, 11); and a common radiating aperture for said two signals.

2. A device according to claim 1, wherein each of the radiating elements is excited by a linearly or circularly polarized printed antenna.

3. A device according to claim 2, wherein the antennas, respectively formed by the resonating plate (12) and by the resonating ring (13) are fed via matched coaxial feed (14, 15, 16, 17).

4. A device according to claim 3, wherein the matched coaxial feeds (14, 15, 16, 17) for each antenna (12, 13) are situated at 90° from each other relative to the center of the waveguides, each coaxial feed being fed in phase quadrature by a hybrid coupler (18, 19).

5. A device according to claim 2, wherein the higher frequency antenna (12) is separated from the end of the associated waveguide (10) by a dielectric (20), and the lower frequency antenna (13) is separated from the end of the associated waveguide (11) by a dielectric (21).

6. A device according to claim 2, wherein both antennas are constituted by respective pairs of resonators, thereby enabling the passband of the device to be increased.

7. A device according to claim 6, wherein the first waveguide (10) is excited at the higher frequencies by two concentric disks (12 and 22) spaced apart by a dielectric (23), and the second waveguide (11) is excited at the lower frequency by two concentric rings (13 and 24), with the two rings being integrally formed in the device.

8. A device according to claim 2, wherein one of the two antennas is constituted by a single resonator excited by four coaxial feeds (25, 26, 27, 28; 30, 31, 32, 33) fed in quadrature.

9. A device according to claim 1, wherein the second radiating element is a plane array.

* * * * *